US007316843B2

(12) United States Patent
Mooney et al.

(10) Patent No.: US 7,316,843 B2
(45) Date of Patent: Jan. 8, 2008

(54) MELT-SPUN SYNTHETIC FIBER AND PROCESS FOR PRODUCING THE FIBER

(75) Inventors: Samuel Mooney, Huntsville, AL (US); Ralf Koehnen, Wuppertal (DE); Britta Konrad, Wuppertal (DE); Qiao Xiao, Erlenbach (DE); Ralf Schnell, Seligenstadt (DE)

(73) Assignee: Polyamide High Performance GmbH, Wuppertal (DE)

( * ) Notice: Subject to any disclaimer, the term of this patent is extended or adjusted under 35 U.S.C. 154(b) by 297 days.

(21) Appl. No.: 10/846,701

(22) Filed: May 17, 2004

(65) Prior Publication Data

US 2004/0214962 A1 Oct. 28, 2004

Related U.S. Application Data

(63) Continuation-in-part of application No. 10/397,368, filed on Mar. 27, 2003, now abandoned.

(51) Int. Cl.
*B32B 3/00* (2006.01)

(52) U.S. Cl. ..... 428/364; 428/375; 428/391; 428/394; 264/211.1

(58) Field of Classification Search ..... 428/375, 428/364, 391, 394, 395
See application file for complete search history.

(56) References Cited

U.S. PATENT DOCUMENTS

| | | | | |
|---|---|---|---|---|
| 3,810,956 | A * | 5/1974 | Kimura | 525/408 |
| 3,915,912 | A * | 10/1975 | Ishicawa et al. | 524/322 |
| 4,052,493 | A * | 10/1977 | Etchells | 264/49 |
| 4,091,022 | A * | 5/1978 | Etchells | 521/85 |
| 4,319,831 | A * | 3/1982 | Matsui et al. | 399/353 |
| 5,397,807 | A * | 3/1995 | Hitchcock et al. | 521/76 |
| 6,362,288 | B1 | 3/2002 | Brewer et al. | |

FOREIGN PATENT DOCUMENTS

| | | | |
|---|---|---|---|
| JP | 48053024 | A * | 7/1973 |
| JP | 50111394 | A * | 9/1975 |
| WO | WO 2004/037106 | A2 | 5/2004 |
| WO | WO 2004/037926 | A2 | 5/2004 |

OTHER PUBLICATIONS

JP 73038341 B, 1973, Japan, Toyo Spinning Co.*

* cited by examiner

*Primary Examiner*—Jill Gray
(74) *Attorney, Agent, or Firm*—Oliff & Berridge, PLC

(57) ABSTRACT

A melt-spun synthetic fiber and process for producing the fiber are described, the fiber including a fiber-forming synthetic polymer and a siloxane-based polyamide with a repeating unit having the formula (I)

(I)

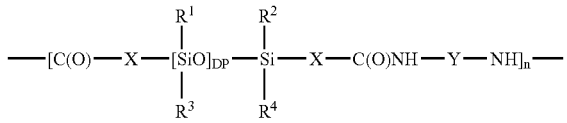

wherein n is a number in the range of 1-500 inclusive and specifics the number of repeating units of the siloxane-based polyamide, DP is the average degree of polymerization of the siloxane component of the siloxane-based polyamide and is in the range of 1-700 inclusive, X is selected from the group consisting of linear or branched alkylene chains having 1-30 carbon atoms, Y is selected from the group consisting of linear or branched alkylene chains having 1-40 carbon atoms, and each of the $R^1$-$R^4$ groups is independently selected from the group consisting of methyl groups, ethyl groups, propyl groups, isopropyl groups, siloxane chains, phenyl groups, and phenyl groups that have been substituted with 1-3 members selected from the group consisting of methyl groups and ethyl groups.

24 Claims, No Drawings

MELT-SPUN SYNTHETIC FIBER AND PROCESS FOR PRODUCING THE FIBER

This is a Continuation-in-Part of application Ser. No. 10/397,368 filed Mar. 27, 2003 now abandoned. The entire disclosure of the prior application is hereby incorporated by reference herein in its entirety.

BACKGROUND OF THE INVENTION

The present invention relates to a melt-spun synthetic fiber and a process for producing the fiber.

In producing melt-spun synthetic fibers, it is well-known that additives can be added in order to improve the properties of the yarns or the spinning process.

JP-A 48 042 052 describes the mixing and spinning of a polyamide mixture with an additive consisting of an ethylene-oxide/propylene-oxide copolymer that contains ethylene-oxide units of a polysiloxane/ethylene-oxide copolymer. The resulting yarn exhibits fewer filament breaks and a higher tensile strength than a similar yam without an additive.

JP-A 71 042 028 describes a composition of a polyamide and a polyalkylene ether containing silicon. The composition exhibits improved antistatic and spinning properties.

However, there is still a need for additional melt-spun synthetic fibers. It is therefore an object of the present invention to provide an additional melt-spun synthetic fiber and a process for producing the fiber.

SUMMARY

The objects of the invention include a melt-spun synthetic fiber and process for producing the fiber, in which the fiber comprises a fiber-forming synthetic polymer and a siloxane-based polyamide additive.

DETAILED DESCRIPTION OF PREFERRED EMBODIMENTS

Some of the objects of the invention are achieved by a melt-spun synthetic fiber comprising a fiber-forming synthetic polymer and an additive that is a siloxane-based polyamide with a repeat unit having the formula (I)

(I)

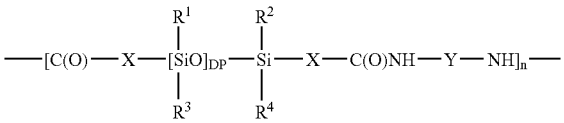

wherein n is a number selected from the group consisting of 1-500 and specifies the number of repeating units of the siloxane-based polyamide, DP is the average degree of polymerization of the siloxane component of the siloxane-based polyamide and is in the range of 1-700 inclusive, X is selected from the group consisting of linear or branched alkylene chains having 1-30 carbon atoms, Y is selected from the group consisting of linear or branched alkylene chains having 1-40 carbon atoms, and each of the $R^1$-$R^4$ groups is independently selected from the group consisting of methyl groups, ethyl groups, propyl groups, isopropyl groups, siloxane chains, phenyl groups, and phenyl groups that have been substituted with 1-3 members selected from the group consisting of methyl groups and ethyl groups.

In preferred embodiments of the melt-spun synthetic fiber according to the invention, the siloxane-based polyamide has n in the range of 1-100 inclusive, DP in the range of 10-500 inclusive, X selected from the group consisting of linear and branched alkylene chains having 3-10 carbon atoms, Y is selected from the group consisting of linear and branched alkylene chains having 1-20 carbon atoms, and $R^1$-$R^4$ each selected from the group consisting of methyl groups and ethyl groups.

In especially preferred embodiments of the melt-spun synthetic fiber according to the invention, the siloxane-based polyamide has n in the range of 4-25 inclusive, DP in the range of 15-100 or most preferred 15-45 inclusive, X is selected from the group consisting of linear and branched alkylene chains having 5-10 or most preferred 10 carbon atoms, Y selected from the group consisting of linear and branched alkylene chains having 2-6 or most preferred 6 carbon atoms, and $R^1$-$R^4$ each being methyl groups.

Furthermore, in Y (a) the alkylene chain can optionally and additionally contain in the alklyene component at least one of the following structures:

(i) 1-3 amide bonds, (ii) $C_5$ or $C_6$ cycloalkane, and (iii) phenylene, optionally substituted with 1-3 members that are, independently of one another, $C_1$-$C_3$ alkyls, (b) the alkylene chain itself can optionally have been substituted with at least one of the following structures:

(i) hydroxy, (ii) $C_3$-$C_8$ cycloalkane, (iii) 1-3 members that are, independently of one another, $C_1$-$C_3$ alkyls or phenyl that has optionally been substituted with 1-3 members that are, independently of one another, $C_1$-$C_3$ alkyls, (iv) $C_1$-$C_3$ alkylhydroxy, or (v) $C_1$-$C_6$ alkyl amine, and (c) Y can be equal to Z, where Z is equal to $T(R^{20})(R^{21})(R^{22})$, where $(R^{20})$, $(R^{21})$, and $(R^{22})$ are, independently of one another, linear or branched $C_1$-$C_{10}$ alkylenes, and T is equal to CR, where R is hydrogen, the group defined by $R^1$-$R^4$, or a trivalent atom such as N, P, or Al.

Corresponding to formula (I), the siloxane-based polyamide of the melt-spun synthetic fiber according to the invention must have a siloxane component in its backbone. However, the siloxane-based polyamide additionally may have a siloxane component in a pendant or branched portion.

X, Y, DP, and $R^1$-$R^4$ can be the same for each repeating unit of the siloxane-based polyamide. In this case, the siloxane-based polyamide is a linear homopolymer. However, X, Y, DP, and $R^1$-$R^4$ can differ in the repeating units of the siloxane-based polyamide. In this case, a copolymer results wherein the repeating units follow one another in a random, alternating, or blockwise manner.

The melt-spun synthetic fiber according to the invention can contain the siloxane-based polyamide of formula (I) as a homopolymer, as one of the aforementioned copolymers, as a physical mixture of one or more of the copolymers, or as a physical mixture of one or more of the copolymers with the homopolymer.

In the scope of the present invention, the term "fiber-forming synthetic polymer" refers to the synthetic polymers known to one skilled in the art or developed in the future that are spinnable in the molten state. A polyamide such as nylon-6 or nylon-4,6, in particular nylon-6,6, is preferred as the fiber-forming synthetic polymer.

Additives of the formula (I) are known from U.S. Pat. No. 6,051,216 and U.S. Pat. No. 5,981,680, and are described in these specifications for use as gelation agents in hair, skin, and underarm cosmetic products. Surprisingly, it was discovered that melt-spun synthetic fibers containing the additive of formula (I) exhibit reduced electrostatic charge and opening length. The latter is between 10 and 30 mm and preferably about 20 mm.

In a preferred embodiment of the melt-spun synthetic fiber according to the invention, the fiber comprises 0.01 to 5% by weight, especially preferably 0.1 to 3% by weight, of additive, referred to the fiber-forming synthetic polymer.

In a further preferred embodiment of the melt-spun synthetic fiber according to the invention, the fiber additionally contains a compatibilizer, and the weight of the additive and compatibilizer is 0.01 to 5% by weight, preferably 0.1 to 3% by weight, relative to the fiber-forming synthetic polymer, where the fiber contains the additive and the compatibilizer in a ratio of preferably 80 to <100 parts by weight, and especially preferably 80 to 95 parts by weight, of additive and preferably >0 to 20 parts by weight, and especially preferably 5 to 20 parts by weight, of the compatibilizer.

The selection of the compatibilizer depends on the fiber-forming synthetic polymer used. In an especially preferred embodiment of the melt-spun synthetic fiber according to the invention, the fiber-forming synthetic polymer is nylon-6,6 and the compatibilizer is polyethylene glycol.

Underlying objects of the invention are furthermore achieved by a process for producing a melt-spun synthetic fiber, comprising a fiber-forming synthetic polymer and an additive, wherein the additive is added during production of the fiber-forming synthetic polymer or added to the fiber-forming synthetic polymer before or after melting, and the additive is a siloxane-based polyamide with a repeating unit having the formula (I)

(I)

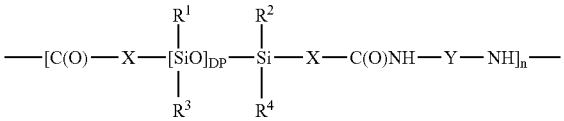

wherein n is a number selected from the group consisting of 1-500 and specifies the number of repeating units of the siloxane-based polyamide, DP is the average degree of polymerization of the siloxane component of the siloxane-based polyamide and is in the range of 1-700 inclusive, X is selected from the group consisting of linear or branched alkylene chains having 1-30 carbon atoms, Y is selected from the group consisting of linear or branched alkylene chains having 1-40 carbon atoms, and each of the $R^1$-$R^4$ groups is independently selected from the group consisting of methyl groups, ethyl groups, propyl groups, isopropyl groups, siloxane chains, phenyl groups, and phenyl groups that have been substituted with 1-3 members of the group consisting of methyl groups and ethyl groups; and melt-spinning the fibers.

In preferred embodiments of the process according to the invention, the siloxane-based polyamide has n in the range of 1-100 inclusive, DP in the range of 10-500 inclusive, X selected from the group consisting of linear and branched alkylene chains having 3-10 carbon atoms, Y selected from the group consisting of linear and branched alkylene chains having 1-20 carbon atoms, and $R^1$-$R^4$ each selected from the group consisting of methyl groups and ethyl groups.

In especially preferred embodiments of the process according to the invention, the siloxane-based polyamide has n in the range of 4-25 inclusive, DP in the range of 15-100 or most preferred 15-45 inclusive, X selected from the group consisting of linear and branched alkylene chains having 5-10 or most preferred 10 carbon atoms, Y selected from the group consisting of linear and branched alkylene chains having 2-6 or most preferred 6 carbon atoms, and $R^1$-$R^4$ each being methyl groups.

Furthermore, the additive used in the process according to the invention and having the repeating unit of formula (I) can have the following composition of Y.

(a) The alkylene chain of Y can optionally and additionally contain in the alklyene component at least one of the following structures:

(i) 1-3 amide bonds, (ii) $C_5$ or $C_6$ cycloalkane, and (iii) phenylene, optionally substituted with 1-3 members that are, independently of one another, $C_1$-$C_3$ alkyls.

(b) The alkylene chain itself of Y can optionally be substituted by at least one of the following structures:

(i) hydroxy, (ii) $C_3$-$C_8$ cycloalkane, (iii) 1-3 members that are, independently of one another, $C_1$-$C_3$ alkyls or phenyl that has optionally been substituted with 1-3 members that are, independently of one another, $C_1$-$C_3$ alkyls, (iv) $C_1$-$C_3$ alkylhydroxy, or (v) $C_1$-$C_6$ alkyl amine.

(c) Y can be equal to Z, where Z is equal to $T(R^{20})(R^{21})(R^{22})$, where $(R^{20})$, $(R^{21})$, and $(R^{22})$ are, independently of one another, linear or branched $C_1$-$C_{10}$ alkylenes, and T is equal to CR, where R is hydrogen, the groups defined by $R^1$-$R^4$, or a trivalent atom such as N, P, or Al.

Corresponding to formula (1), the siloxane-based polyamide of the process according to the invention must have a siloxane component in its backbone. However, the siloxane-based polyamide additionally may have a siloxane component in a pendant or branched portion.

In the process according to the invention, the additive can be a siloxane-based polyamide with the repeat unit of formula (I), where X, Y, DP, and $R^1$-$R^4$ are the same for each repeating unit. In this case, the siloxane-based polyamide is a linear homopolymer.

Likewise, in the process according to the invention, the additive can be a siloxane-based polyamide in which the values of X, Y, DP, and $R^1$-$R^4$ differ in different repeating units. In this case, a copolymer is used in the process according to the invention whose repeating units follow one another in a random, alternating, or blockwise manner.

Finally, in the process according to the invention, the siloxane-based polyamide of formula (I) can be used as a physical mixture of one or more of the aforementioned homopolymers or copolymers, or one or more of the copolymers with one or more of the homopolymers.

Surprisingly, the process according to the invention, which comprises the use of the siloxane-based polyamide as the additive, leads to a reduction of the mean and range of variation of the pressure in the extruder head and to a reduction of the nozzle pressure.

Within the scope of the present invention, fiber-forming synthetic polymers are understood to be the synthetic polymers known to one skilled in the art or developed in the future that are spinnable in the molten state. A polyamide such as nylon-6 or nylon-4,6, in particular nylon-6,6, is preferred as the fiber-forming synthetic polymer.

In a preferred embodiment of the process according to the invention, the additive is used in a ratio of 0.01 to 5% by weight, especially preferably 0.1 to 3% by weight, referred to the fiber-forming synthetic polymer.

In a further preferred embodiment of the process according to the invention, a compatibilizer is also used, where the weight of the additive and the compatibilizer is 0.01 to 5% by weight, especially preferably 0.1 to 3% by weight, relative to the weight of the fiber-forming synthetic polymer, where the additive and the compatibilizer are used in a ratio of preferably 80 to <100 parts by weight, and especially preferably 80 to 95 parts by weight, of additive and preferably >0 to 20 parts by weight, and especially preferably 5 to 20 parts by weight, of the compatibilizer, relative to the synthetic polymer that forms the melt-spun fiber.

The selection of the compatibilizer depends on the fiber-forming synthetic polymer used. In especially preferred embodiments of the process according to the invention, the fiber-forming synthetic polymer used is nylon-6,6 and the compatibilizer used is polyethylene glycol.

As previously noted, the additive can be added during the production of the fiber-forming synthetic polymer, where the additive can be added together with a compatibilizer. In this case, the additive and, if applicable, the compatibilizer are preferably added in the form of an aqueous dispersion.

It has also been noted that the additive can be added to the fiber-forming synthetic polymer prior to melting, where the additive can be added together with a compatibilizer. In this case, granules-of the fiber-forming synthetic polymer can be mixed with granules or a powder of the additive and, if applicable, the compatibilizer, and fed to an extruder. Furthermore, an aqueous dispersion of the additive and, if applicable, the compatibilizer can be applied, such as by spraying, to granules of the fiber-forming synthetic polymer, after which the granules are dried and fed to an extruder.

Finally, as previously noted, the additive—if applicable, together with a compatibilizer—can be added to the fiber-forming synthetic polymer after melting, where the additive and, if applicable, the compatibilizer are fed to the molten fiber-forming synthetic polymer as granules or in the molten state

EXAMPLES

The invention will be described in more detail with reference to the following examples.

Comparative Example 1

Nylon-6,6 with a solution viscosity of 2.55 (measured in 90% acetic acid at 25° C. in an Ubbelohde viscometer) is melted in a single-screw extruder at 307° C., spun through a 72-hole nozzle (hole diameter 200 μm) with a drafting factor of 14, directed through a rectangular quenching duct with a length of 1200 mm and width of 150 mm, where the quenching-air flow is 300 $m^3$/h, and wound up at a rate of 450 m/min. The resulting yam has 350 dtex/f72.

Example 1

Nylon-6,6 is spun as in Comparative Example 1, except that 2% by weight of additive no. 8179, available from Dow Corning and having the formula (Ia)

(Ia)

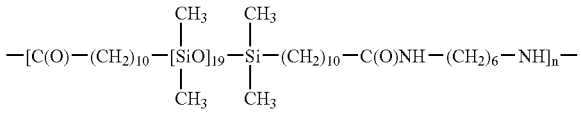

is used, where the additive is gradually added to the nylon-6,6 prior to melting, in ground form with a mean particle size of 0.6 to 1.6 mm using a gravimetric metering device (Engelhard system).

Example 2

Nylon-6,6 is spun as in Example 1, except that 2% by weight of additive no. 8178, commercially available from Dow Coming, is used. It consists of 85-90 parts by weight of the additive of formula (Ia) and 10-15 parts by weight of polyethylene glycol as a compatibilizer. This additive is ground and sieved prior to use. The sieve fraction with particle sizes in the range of 0.6 to 3 mm is used.

Example 3

Nylon-6,6 is spun as in example 2, except that 1% by weight of additive no. 8178, commercially available from Dow Corning, is used.

In Table 1, the extruder-head pressure EP and in parentheses its range of variation are listed. In addition, Table 1 contains the nozzle pressure NP and an assessment of the spinnability. Comparison of Examples 1-3 with Comparative Example 1 shows that the use of the additive with the formula (Ia) and, if applicable, the compatibilizer polyethylene glycol reduces the nozzle pressure. Comparison of Examples 2 and 3 with Comparative Example 1 shows that, when using the additive and compatibilizer, the extruder-head pressure EP decreases. Comparison of Examples 1 and 3 with Comparative Example 1 shows that the use of the additive and, if applicable, the compatibilizer reduces the range of variation of the extruder-head pressure.

TABLE 1

| | Additive | EP [bar] | NP [bar] | Spinnability |
|---|---|---|---|---|
| Comparative Example 1 | — | 70 (50-90) | 119 ± 0.5 | Good |
| Example 1 | 2% by weight of no. 8179 | 70 (65-80 | 110 ± 1 | Good |
| Example 2 | 2% by weight of no. 8178 | 55 (30-80) | 110 ± 5 | Good |
| Example 3 | 1% by weight of no. 8178 | 60 (40-75) | 115 ± 5 | Good |

Comparative Example 2

The nylon-6,6 yarn obtained in Comparative Example 1 is finished with an aqueous, commercially available preparation. The friction [cN] and coefficient of friction of the finished yam were measured with a Rothschild F-meter (5 Degussit pins in a plowshare arrangement, 180° looping angle, 5 cN pretension), and the electrostatic charge [kV/m] measured with an Eltex device (an accessory to the Rothschild F meter) for various testing rates.

Example 4

The nylon-6,6 yam obtained in Example 1 is subjected to a finish and measured as in Comparative Example 2.

Example 5

The nylon-6,6 yam obtained in Example 2 is subjected to a finish and measured as in Comparative Example 2.

Table 2 shows the friction, coefficient of friction, and electrostatic charge of the yams of Comparative Example 2 and Examples 4 and 5 for various testing rates.

TABLE 2

| | | Testing rate [m/min] | | |
|---|---|---|---|---|
| | Test parameter | 50 | 100 | 200 |
| Comparative | Friction [cN] | 27 | 34 | 42 |
| Example 2 | Coefficient of friction | 0.54 | 0.62 | 0.67 |
| | Electrostatic charge [kV/m] | 0.85 | 1.6 | 1.35 |
| Example 4 | Friction [cN] | 27 | 33 | 38 |
| | Coefficient of friction | 0.53 | 0.61 | 0.65 |
| | Electrostatic charge [kV/m] | 0.9 | 0.65 | 0.4 |
| Example 5 | Friction [cN] | 33 | 42 | 48 |
| | Coefficient of friction | 0.61 | 0.68 | 0.73 |
| | Electrostatic charge [kV/m] | 0 | 0.05 | −0.05 |

Comparison of Examples 4 and 5 with Comparative Example 2 shows that a nylon-6,6 yarn with the additive of formula (Ia) and, if applicable, the compatibilizer polyethylene glycol, at least at testing rates of 100 and 200 [m/min], exhibits a considerably lower electrostatic charge than the nylon-6,6 yarn of Comparative Example 2. Example 5 shows that the electrostatic charge can be practically eliminated over the entire testing-rate range.

What is claimed is:

1. A melt-spun synthetic fiber comprising a fiber-forming synthetic polymer and an additive, wherein the additive is a siloxane-based polyamide with a repeating unit having the formula (I)

(I)

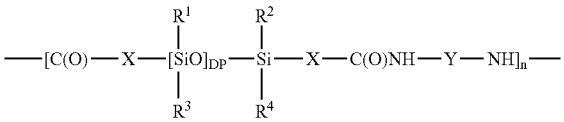

wherein n is a number in the range of 1-500 inclusive and specifies the number of repeating units of the siloxane-based polyamide, DP is the average degree of polymerization of the siloxane component of the siloxane-based polyamide and is in the range of 1-700 inclusive, X is selected from the group consisting of linear and branched alkylene chains having 1-30 carbon atoms, Y is selected from the group consisting of linear and branched alkylene chains having 1-40 carbon atoms, and each of the $R^1$-$R^4$ groups is selected independently from the group consisting of methyl groups, ethyl groups, propyl groups, isopropyl groups, siloxane chains, phenyl groups, and phenyl groups that have been substituted with 1-3 members of the group consisting of methyl groups and ethyl groups;

wherein the fiber further comprises a compatibilizer;

wherein the compatibilizer is polyethylene glycol;

wherein the fiber comprises 0.01 to 5% by weight of the additive relative to the fiber-forming synthetic polymer; and wherein the weight of the additive and the compatibilizer together is 0.01 to 5% by weight relative to the fiber-forming synthetic polymer.

2. A melt-spun synthetic fiber according to claim 1, wherein n is in the range of 1-100 inclusive, DP is in the range of 10-500 inclusive, X is selected from the group consisting of linear and branched alkylene chains having 3-10 carbon atoms, Y is selected from the group consisting of linear and branched alkylene chains having 1-20 carbon atoms, and $R^1$-$R^4$ are each selected from the group consisting of methyl groups and ethyl groups.

3. A melt-spun synthetic fiber according to claim 2, wherein n is in the range of 4-25 inclusive, DP is in the range of 15-45 inclusive, X is selected from the group consisting of linear and branched alkylene chains having 5-10 carbon atoms, Y is selected from the group consisting of linear and branched alkylene chains having 2-6 carbon atoms, and $R^1$-$R^4$ are methyl groups.

4. A melt-spun fiber according to claim 1, wherein the fiber is a polyamide.

5. A melt-spun fiber according to claim 1, wherein the fiber-forming synthetic polymer is nylon-6,6.

6. A process for producing a melt-spun synthetic fiber comprising a fiber-forming synthetic polymer and an additive, comprising adding an additive and a compatibilizer, wherein the compatibilizer is polyethylene glycol (a) during production of the fiber-forming synthetic polymer, or (b) to the fiber-forming synthetic polymer before or after melting, wherein the additive is a siloxane-based polyamide with a repeating unit having the formula (I)

(I)

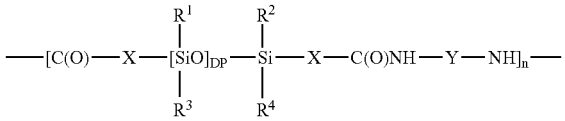

wherein n is a number in the range of 1-500 inclusive and specifies the number of repeating units of the siloxane-based polyamide, DP is the average degree of polymerization of the siloxane component of the siloxane-based polyamide and is in the range of 1-700 inclusive, X is selected from the group consisting of linear and branched alkylene chains having 1-30 carbon atoms, Y is selected from the group consisting of linear and branched alkylene chains having 1-40 carbon atoms, and each of the $R^1$-$R^4$ groups is selected independently from the group consisting of methyl groups, ethyl groups, propyl groups, isopropyl groups, siloxane chains, phenyl groups, and phenyl groups that have been substituted with 1-3 members of the group consisting of methyl groups and ethyl groups; and melt-spinning the;

wherein the fiber comprises 0.01 to 5% by weight of the additive relative to the fiber-forming synthetic polymer; and wherein the weight of the additive and the compatibilizer together is 0.01 to 5% by weight relative to the fiber-forming synthetic polymer.

7. A process according to claim 6, wherein n is in the range of 1-100 inclusive, DP is in the range of 10-500 inclusive, X is selected from the group consisting of linear and branched alkylene chains having 3-10 carbon atoms, Y is selected from the group consisting of linear and branched alkylene chains having 1-20 carbon atoms, and $R^1$-$R^4$ are each selected from the group consisting of methyl groups and ethyl groups.

8. A process according to claim 7, wherein n is in the range of 4-25 inclusive, DP is in the range of 15-45 inclusive, X is selected from the group consisting of linear and branched alkylene chains having 5-10 carbon atoms, Y is selected from the group consisting of linear and branched alkylene chains having 2-6 carbon atoms, and $R^1$-$R^4$ are methyl groups.

9. A process according to claim 6, wherein the fiber is a polyamide.

10. A process according to claim 6, wherein the fiber-forming synthetic polymer is nylon-6,6.

11. A process according to claim 6, wherein the additive is added during the production of the fiber-forming synthetic polymer and the additive is in the form of an aqueous dispersion.

12. A process according to claim 6, wherein the additive and a compatibilizer are added during the production of the fiber-forming synthetic polymer and the additive and the compatibilizer are in the form of an aqueous dispersion.

13. A process according to claim 6, wherein granules of fiber-forming synthetic polymer are mixed with granules of the additive and fed to an extruder prior to melting the fiber-forming synthetic polymer.

14. A process according to claim 6, wherein granules of fiber-forming synthetic polymer are mixed with a powder of the additive and fed to an extruder prior to melting the fiber-forming synthetic polymer.

15. A process according to claim 6, wherein granules of fiber-forming synthetic polymer are mixed with granules of the additive and of the compatibilizer and fed to an extruder prior to melting the fiber-forming synthetic polymer.

16. A process according to claim 6, wherein granules of fiber-forming synthetic polymer are mixed with a powder of the additive and of the compatibilizer and fed to an extruder prior to melting the fiber-forming synthetic polymer.

17. A process according to claim 6, wherein an aqueous dispersion of the additive is applied to granules of the fiber-forming synthetic polymer, and the granules are dried and fed to an extruder, prior to melting the fiber-forming synthetic polymer.

18. A process according to claim 6, wherein an aqueous dispersion of the additive and the compatibilizer is applied to granules of the fiber-forming synthetic polymer, and the granules are dried and fed to an extruder, prior to melting the fiber-forming synthetic polymer.

19. A process according to claim 6, wherein the additive is added to the fiber-forming synthetic polymer after melting.

20. A process according to claim 19, wherein the additive is added to the fiber-forming synthetic polymer as granules.

21. A process according to claim 19, wherein the additive is added to the fiber-forming synthetic polymer in the molten state.

22. A process according to claim 6, wherein the additive and the compatibilizer are added to the fiber-forming synthetic polymer after melting.

23. A process according to claim 22, wherein the additive and the compatibilizer are added to the fiber-forming synthetic polymer as granules.

24. A process according to claim 22, wherein the additive and the compatibilizer are added to the fiber-forming synthetic polymer in the molten state.

* * * * *

UNITED STATES PATENT AND TRADEMARK OFFICE

CERTIFICATE OF CORRECTION

PATENT NO. : 7,316,843 B2
APPLICATION NO. : 10/846701
DATED : January 8, 2008
INVENTOR(S) : Samuel Mooney et al.

It is certified that error appears in the above-identified patent and that said Letters Patent is hereby corrected as shown below:

Title page, item (57) Abstract, second line after chemical figure, delete “specifics” and insert --specifies--

(Column 1, line 22) Delete “similar yam” and insert --similar yarn--

(Column 5, line 60) Delete “resulting yam” and insert --resulting yarn--

(Column 6, line 50) Entry under EP [bar] for Example 1 delete “70 (65-80” and insert --70 (65-80)--

(Column 6, line 63) Delete “finished yam” and insert --finished yarn--

(Column 7, line 3) Delete “nylon-6, 6 yam” and insert --nylon-6, 6 yarn--

(Column 7, line 8) Delete “nylon-6, 6 yam” and insert --nylon-6, 6 yarn--

(Column 7, line 11) Delete “the yams” and insert --the yarns--

(Column 8, line 61) Delete “melt-spinning the;” and insert --melt-spinning the fiber;--

Signed and Sealed this

Seventeenth Day of June, 2008

JON W. DUDAS
*Director of the United States Patent and Trademark Office*